US007500857B2

(12) United States Patent
Schmid et al.

(10) Patent No.: US 7,500,857 B2
(45) Date of Patent: Mar. 10, 2009

(54) ARRANGEMENT WITH A CONTACT ELEMENT

(75) Inventors: Harald Schmid, Emmingen (DE); Hermann Rappenecker, Vöhrenbach (DE); Wilhelm Weisser, Königsfeld (DE); Ralf-Michael Sander, St. Georgen (DE); Alexander Hahn, Sauldorf (DE)

(73) Assignee: EBM-PAPST St. Georgen GmbH & Co. KG, St. Georgen (DE)

( * ) Notice: Subject to any disclaimer, the term of this patent is extended or adjusted under 35 U.S.C. 154(b) by 0 days.

(21) Appl. No.: 10/599,627

(22) PCT Filed: Mar. 26, 2005

(86) PCT No.: PCT/EP2005/003203

§ 371 (c)(1),
(2), (4) Date: Oct. 3, 2006

(87) PCT Pub. No.: WO2005/101933

PCT Pub. Date: Oct. 27, 2005

(65) Prior Publication Data

US 2007/0232096 A1 Oct. 4, 2007

(30) Foreign Application Priority Data

Apr. 8, 2004 (DE) ..... 20 2004 005 963 U

(51) Int. Cl.
*H01R 12/00* (2006.01)

(52) U.S. Cl. ..... 439/78

(58) Field of Classification Search ..... 439/78, 439/80, 81, 82, 83, 876, 853, 747, 8, 947
See application file for complete search history.

(56) References Cited

U.S. PATENT DOCUMENTS 3,790,916 A 2/1974 Keitel ..... 339/95
4,790,764 A * 12/1988 Kawaguchi et al. ..... 439/78

(Continued)

FOREIGN PATENT DOCUMENTS

DE 36 18 108 A1 12/1986

(Continued)

OTHER PUBLICATIONS

Würth Electronics, Inc., Sales Office Contact datasheet, retrieved 2006 from www.wuerth-elektronik.de.

*Primary Examiner*—Ross N Gushi
(74) *Attorney, Agent, or Firm*—Milton Oliver; Oliver Intellectual Property LLC

(57) ABSTRACT

A circuit board (20) is equipped with at least one conductor path (22) and a contact element (44). The latter is adapted to mechanically engage and electrically contact an electrical conductor (66). In the region of a conductor path (22), the circuit board (20) has passthrough orifices (24, 26, 28, 30, 32). The contact element (44) has a base part (46) and feet (34, 36, 38, 40, 42) which press-fit into the orifices (24 to 32) of the circuit board (20). The contact element (44) has a contact tongue (54) that is resiliently articulated on the base part (46) and clamps the electrical conductor (66). This makes possible a secure connection from the electrical conductor (66) to the circuit board (20), e.g. for connecting a device having a large current demand.

14 Claims, 6 Drawing Sheets

U.S. PATENT DOCUMENTS

| | | | | |
|---|---|---|---|---|
| 6,007,376 | A | 12/1999 | Shimizu | 439/571 |
| 6,193,567 | B1 * | 2/2001 | Hsieh | 439/853 |
| 6,295,726 | B1 | 10/2001 | Maatta | 29/827 |
| 6,551,149 | B2 * | 4/2003 | Orihara | 439/862 |
| 6,702,595 | B2 * | 3/2004 | Nelson et al. | 439/83 |
| 6,790,102 | B2 | 9/2004 | Stillabower et al. | 439/856 |
| 6,942,500 | B2 * | 9/2005 | Chen | 439/83 |
| 7,124,501 | B2 * | 10/2006 | Bender | 29/840 |
| 2002/0144398 | A1 * | 10/2002 | Bender | 29/876 |

FOREIGN PATENT DOCUMENTS

| | | | |
|---|---|---|---|
| DE | 38 08 704 | A1 | 10/1989 |
| DE | G 90 03 748.0 | | 5/1991 |
| DE | 295 05 107.8 | | 5/1995 |
| DE | 199 57 014 | A1 | 5/2001 |
| DE | 101 57 113 | A1 | 6/2003 |
| EP | 0 872 919 | A3 | 10/1998 |
| EP | 1 408 584 | A1 | 4/2004 |
| FR | 2 763 751 | A1 | 11/1998 |
| JP | 01140647 | | 6/1989 |

* cited by examiner

ARRANGEMENT WITH A CONTACT ELEMENT

CROSS-REFERENCE

This application is a section 371 of PCT/EP2005/003203, filed 26 Mar. 2005, published as WO 2005/101933 on 27 OCT. 2005. Priority is claimed from German application DE 20 2004 005 963, filed 8 Apr. 2004, the entire content of which is incorporated by reference.

FIELD OF THE INVENTION

The invention relates to an arrangement having a circuit board, which board is equipped with at least one conductor path and a contact element for creating an electrical connection between an electrical conductor and a predetermined conductor path on that circuit board.

BACKGROUND

It is necessary in a variety of applications, for example in automotive engineering, on a ship, or in aviation, to connect, in mechanically and electrically secure fashion, a predetermined conductor path that is located on a circuit board to an electrical conductor coming from outside. This electrical conductor can serve, for example, to supply current, and in that case no interruption in current supply must occur during operation of the vehicle.

This connection can also serve for connection to the electric motor of a safety-relevant application, e.g. to a motor that is controlled from the circuit board. This can be, for example, an application in which a motion is electrically controlled (X-by-wire). Here as well, a reliable connection is required during the entire service life of the motor vehicle, aircraft, ship, or the like.

Consideration must additionally be given to the fact that such electrical connections must be carried out in a manner as compatible as possible with automation, so that they can be manufactured and assembled economically.

SUMMARY OF THE INVENTION

It is therefore an object of the invention to make available a novel arrangement of the kind cited above.

According to the invention, this object is achieved by interconnecting the metallic conductor path on the circuit board and an externally-extending electrical conductor, using a generally three-dimensional contact element, which has feet engaging in metallized holes formed in the board, a base part, and a resilient tongue which both mechanically clamps and electrically contacts the electrical conductor.

The invention yields a reliable mechanical and electrical connection between circuit board and contact element, since the feet are pressed into the orifices of the circuit board (press-in technology). These orifices are electrically connected, by way of their metallizations, to the conductor paths of the circuit board and the circuit present there, and they are electrically and mechanically connected, by being pressed in, to the feet of the contact element. The latter in turn makes possible a reliable connection to the electrical conductor coming from outside.

The contact element is thus already electrically connected to the predetermined conductor path by means of the pressing-in technology, and a planar solder join is additionally obtained between it and the conductor path. A soldered connection is thus produced between the contact element and the conductor path using the so-called reflow method, i.e. upon heating of the circuit board in the reflow oven, solder can travel to all the desired locations. These soldered connections also, in addition to the mechanical and electrical connection resulting from the pressing-in technology, form a secure electrical connection and assist the mechanical connection resulting from being pressed in. Despite cost-optimized processes, excellent functional dependability is thus obtained for the connection between contact element and circuit board/conductor path, both electrically and mechanically.

A primary consideration in the context of the invention is thus to create a connection that is very secure and reliable, and therefore exhibits a certain redundancy.

BRIEF FIGURE DESCRIPTION

Further details and advantageous refinements of the invention are evident from the exemplifying embodiments, in no way to be understood as a limitation of the invention, that are described below and depicted in the drawings. In the drawings.

DETAILED DESCRIPTION

Figure 1:
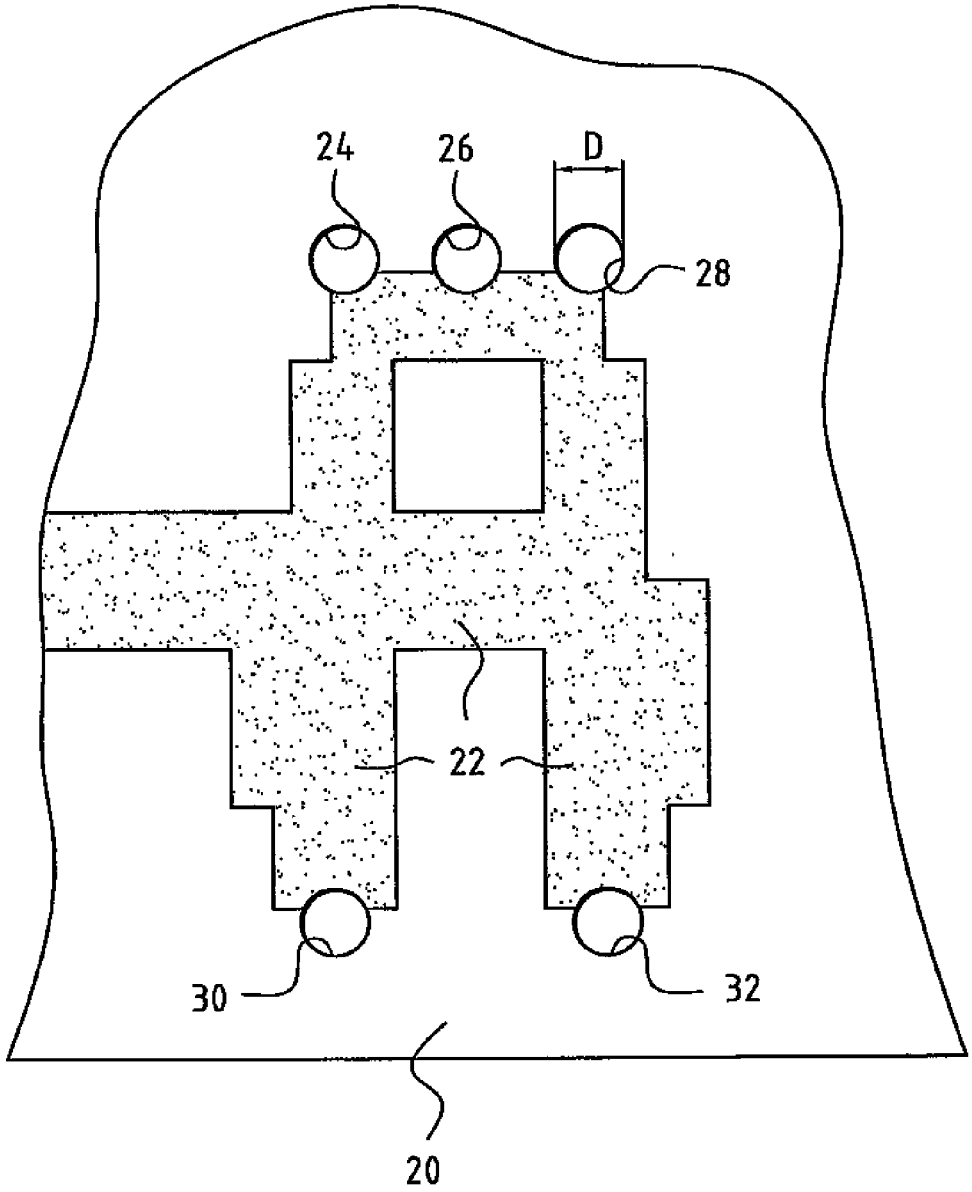
FIG. 1 is a plan view of a circuit board on which a conductor path is present, and which is equipped with holes according to a predetermined pattern.

FIG. 1 shows a circuit board 20 on which is located a conductor path 22 that is usually made of tinned copper. Three holes 24, 26, 28 are provided above conductor path 22 in FIG. 1, and two holes 30, 32 below it.

Figure 2:
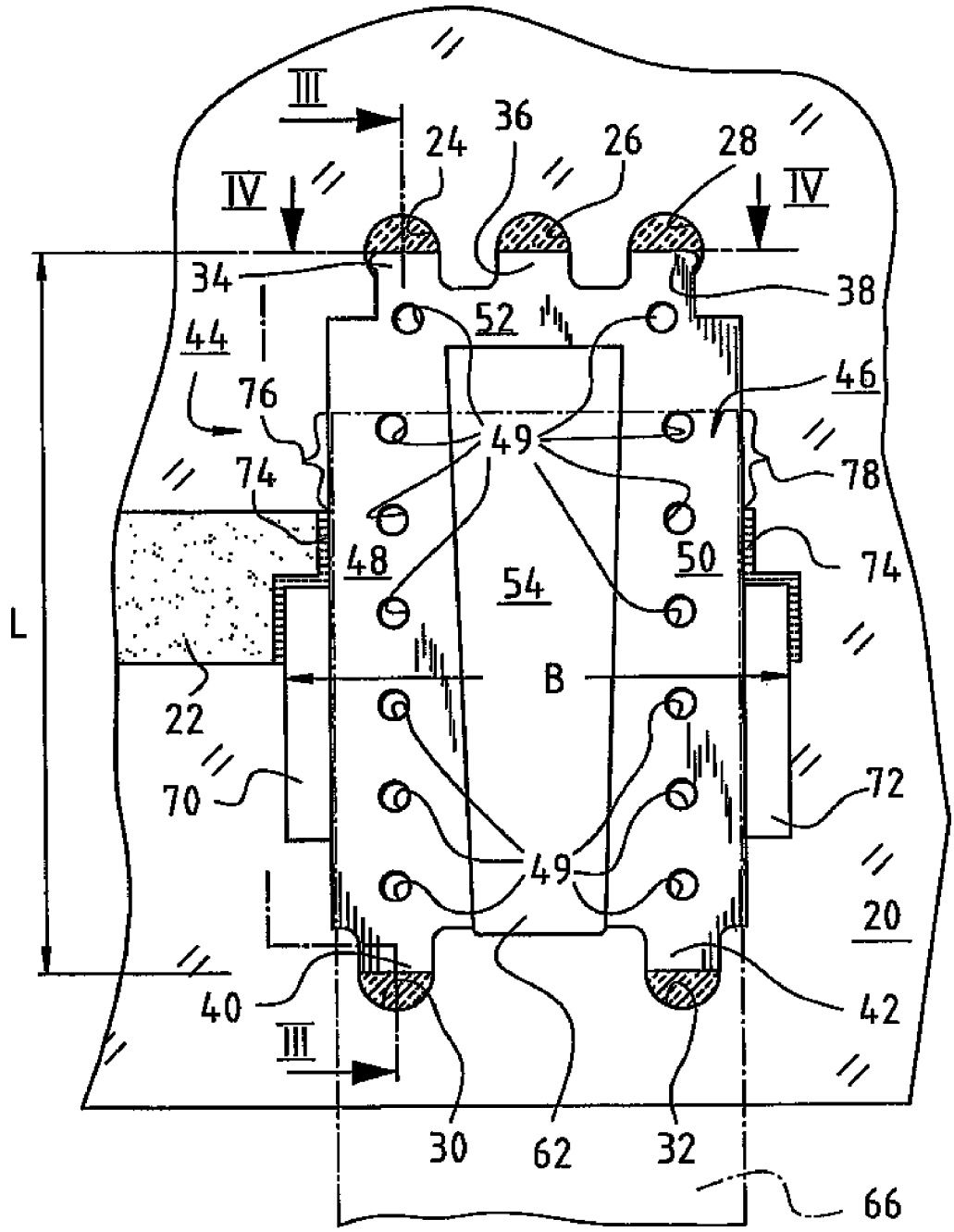
FIG. 2 is a plan view analogous to FIG. 1, in which a contact element according to a first exemplifying embodiment of the invention is mounted on circuit board 20 and electrically connected to the conductor path.

According to FIG. 2, the five feet 34, 36, 38, 40, 42 of a contact element 44 are pressed into these five holes 24 to 32. By being pressed in, contact element 44 is retained in the desired position on circuit board 20. Contact element 44 is usually made of a copper alloy, or of copper, brass, or the like. Conductor path 22 is largely adapted to the shape of contact element 44 in order to enable soldering over a large area.

Figure 4:
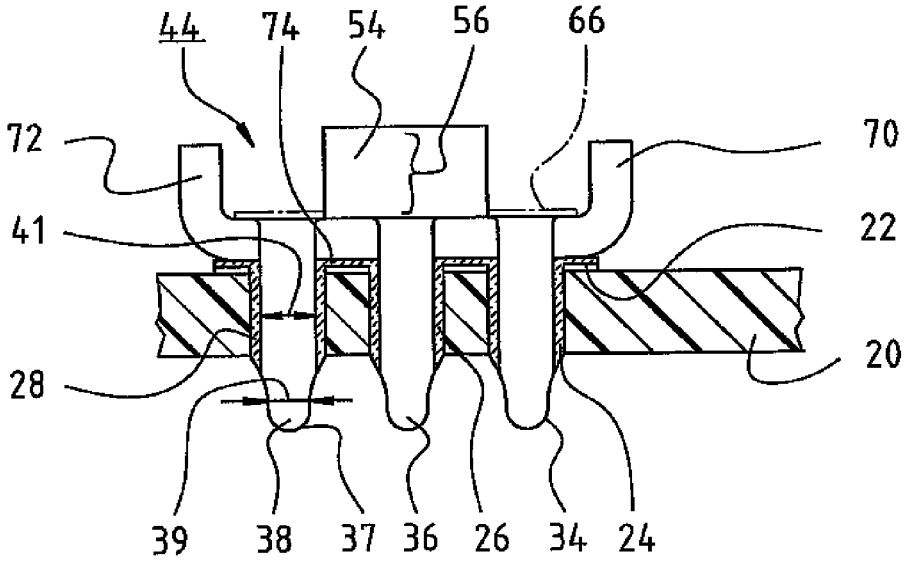
FIG. 4 is a section viewed along line IV-IV of FIG. 2.

As is clearly apparent from FIG. 4, feet 34, 36, 38 preferably have identical shapes. For example, foot 38 has a free end 37, and in the region of that free end 37 it has a reduced width so that it can therewith, when circuit board 20 is being populated, be easily introduced and pressed into opening 28. In its upper part (in FIG. 4), foot 38 has a width 41 which is dimensioned so that it must be pressed into opening 28, i.e. its width 41 exceeds diameter D (FIG. 1) of hole 28, so that upon assembly a press fit is obtained which results in a good mechanical connection. Holes 24 to 32 are metallized, e.g. with copper, at at least one end, in order to produce a good press-in connection and thus a good mechanical, and also electrically conductive, connection.

Figure 3:
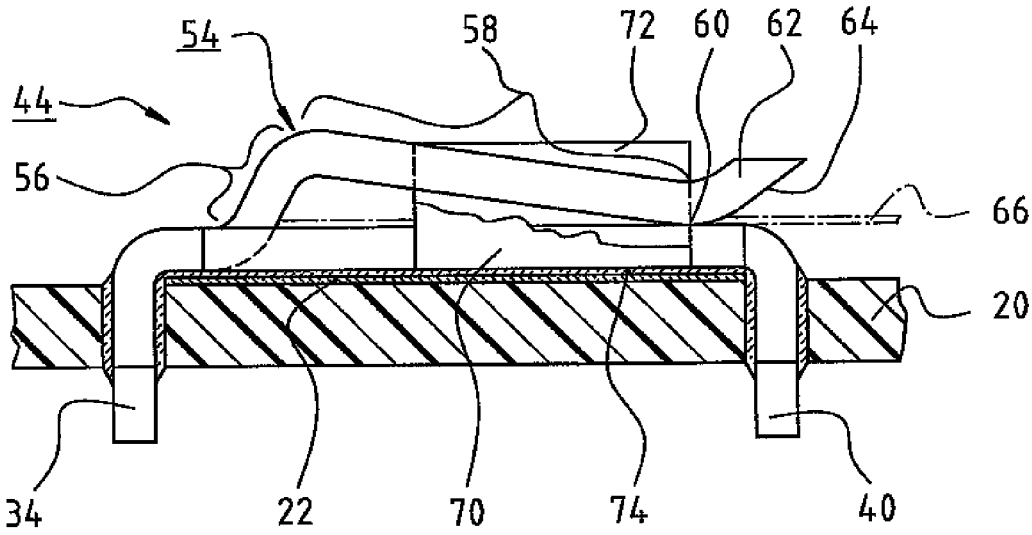
FIG. 3 is a section viewed along line III-III of FIG. 2.

As is evident from FIGS. 2 to 4, contact element 44 can comprise three feet 34, 36, 38 on its upper side (in FIG. 2), and two feet 40, 42 on its lower side. All the feet are electrically and mechanically connected to a base part 46 that in FIG. 2 looks like an inverted U and comprises two limbs 48, 50, and a base 52 that connects those limbs. There can also, however, be only one or two feet.

Stamped out between limbs 48, 50 is a spring tongue 54 that is implemented at its upper end (in FIG. 2) integrally with base 52. Spring tongue 54 has on its left part (in FIG. 3) a portion 56 at which it rises sharply, and which transitions into a slowly declining portion 58 that leads to a contact location 60 and from there slowly rises again at 62, so that on the right (in FIG. 3) an introduction orifice 64 is formed into which a sheet-metal part 66, indicated with dot-dash lines, can be introduced, e.g. for electrical connection to a motor (not depicted) that is to be controlled from circuit board 20, or for connection to a power supply or to any device.

Base part 46 has at the left and the right a respective bent-up cheekpiece 70, 72. Cheekpiece 70 is implemented on limb 48, and cheekpiece 72 on limb 50. These cheekpieces 70, 72 serve as lateral guidance members for sheet-metal part 66 upon installation thereof.

Assembly

Before contact element 44 is pressed in, circuit board 20 is imprinted with solder paste at the requisite locations. Contact element 44 is then pressed into circuit board 20, some of the solder paste ending up in orifices 49 of contact element 44 and being stored in those orifices.

After pressing-in, the electronic components (SMD components) are placed onto the previously printed-on solder paste in the usual fashion; once this has happened, the circuit board is transported through a reflow oven where soldering of all the components takes place.

Only a single intermediate step is thus necessary in the context of the invention, namely the pressing-in of contact element 44. All the other processes must also be carried out for the SMD components, i.e. only very minor additional costs arise for the installation of contact element 44.

With regard to FIG. 1, be it noted that conductor path 22 is adapted to the shape of contact element 44, as is directly evident from a comparison of FIGS. 1 and 2. A large-area solder join is thereby achieved.

To prevent the previously applied solder paste from being completely pushed out to the side when contact element 44 is pressed in, pass-through orifices 49 are provided in base part 46, into which orifices, during this pressing-in operation, the solder paste is partially pressed so that upon soldering in the reflow oven, sufficient solder paste is available to produce a correct soldered connection. These orifices 49 thus serve as a reservoir for the solder paste.

Once its feet 34 to 42 have been pressed into holes 24 to 32 of circuit board 20, contact element 44 is soldered in the reflow oven in the usual fashion. In this context, solder 74 flows into openings 24 to 32 and also flows, by capillary action, under base part 46, with the result that the latter is soldered over a large area to conductor path 22. An additional mechanical connection to circuit board 20 is thereby created. Connection arrangement 44 is likewise securely connected electrically to conductor path 22.

Sheet-metal part 66 for electrical connection can have, for example, a width of 0.8 cm. Preferably it has an orifice into which a lug or the like, provided on spring tongue 54, latches upon assembly in order to enable secure mechanical latching between spring tongue 54 and sheet-metal part 66, which is also useful in the context of assembly.

After insertion, sheet-metal part 66 is permanently welded in non-contact fashion, by welding by means of a laser at two lateral regions, e.g. at locations 76, 78 (so-called laser spots). This allows the welded connection to be produced on a circuit board 20 that is already populated, without thereby allowing electrical components to be damaged or destroyed by external voltages. Welding yields a materially joined connection from contact element 44 to sheet-metal part 66, i.e. a very secure and reliable electrical, and also mechanical, connection.

Figure 5:
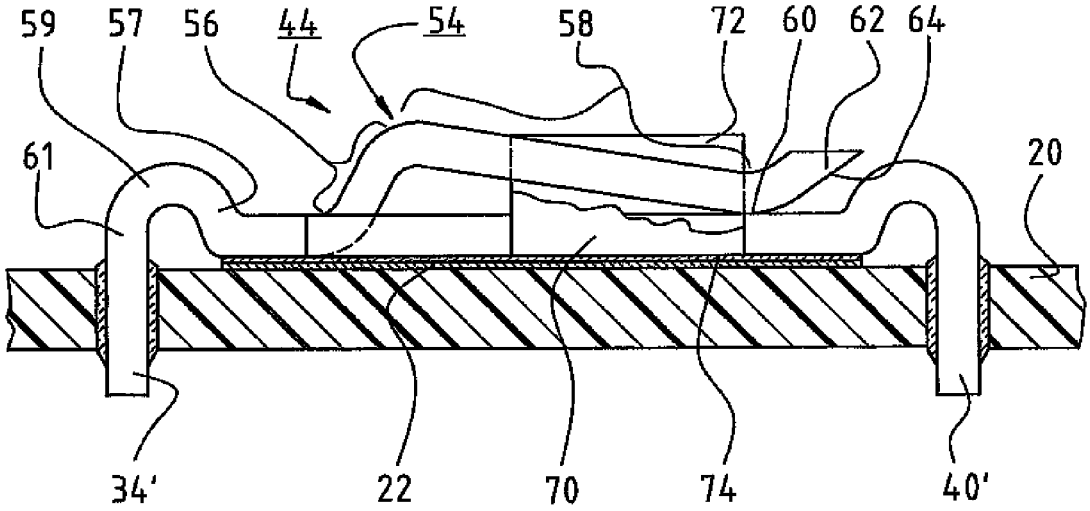
FIG. 5 shows a preferred variant of FIG. 3.

FIG. 5 shows a variant of FIG. 3. Parts identical, or functioning identically, to those in FIG. 3 are therefore labeled with the same reference characters.

In the context of FIG. 3 it can be disadvantageous that upon installation of contact element 44, a gap is created between it and circuit board 20, which gap could interfere with the formation of a secure soldered connection. The reason is that feet 34 to 42 are bent down at a right angle, unavoidably creating a bending radius that can cause the above-described gap during the pressing-in operation.

The variant according to FIG. 5 enables contact element 44 to fit snugly on circuit board 20. In this variant, the feet are first bent upward and then bent over 180 degrees. This is depicted using feet 34' and 40' as examples. Foot 34' is bent upward at location 57, then makes a 180-degree bend at 59 (the radius selected for this bend can, if applicable, be very small) and from there proceeds vertically downward at 61. The same conformation, but in mirror-image, is found in foot 40'.

With this configuration, base part 46 (limbs 48, 50 and base 52) can rest snugly on the circuit board, so that an excellent soldered connection is produced in the reflow oven because the solder can reliably fill up the entire interstice between contact element 44 and conductor path 22. Orifices 49 that were described with reference to FIG. 2 are very advantageous in this context, and are therefore used in the same fashion in the variant according to FIG. 5.

Figure 6:
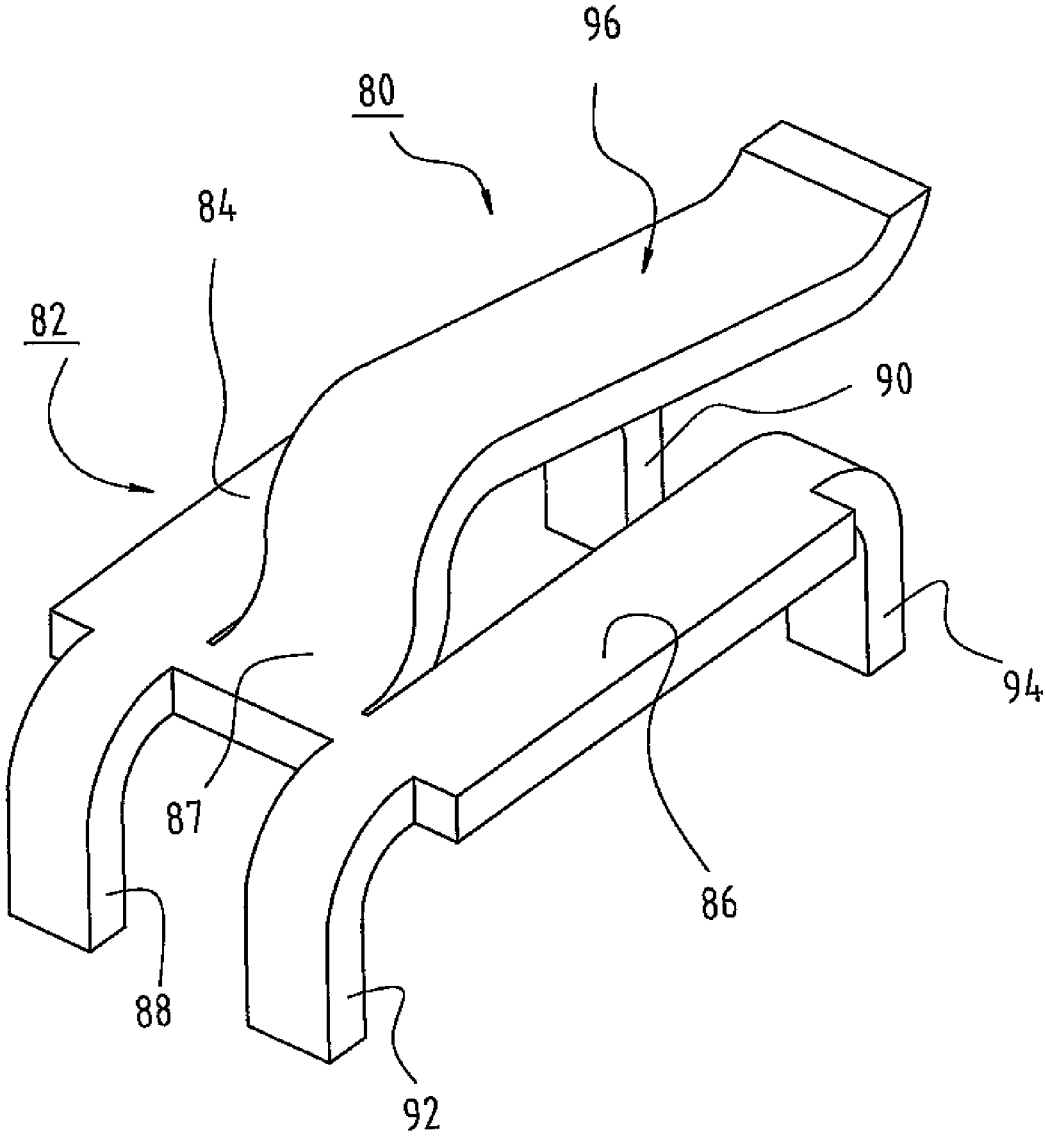
FIG. 6 is a perspective depiction of a simplified contact element according to a second exemplifying embodiment of the invention.

FIG. 6 is a perspective depiction, at a scale of approximately 10:1, of a contact element 80 that is constructed similarly to contact element 44 of FIGS. 1 to 5 but has only four feet. It has a base part 82 having two longitudinal limbs 84, 86 that are connected on one side by a base 87. Two feet 88, 90 are bent down from limb 84, and two feet 92, 94 from limb 86.

A resilient contact tongue 96 is stamped out between limbs 84, 86 and shaped in the manner depicted, in order to enable the introduction of an electrical conductor, e.g. a flat metal part, and in order to retain that flat metal part securely in the introduced position.

Figure 7:
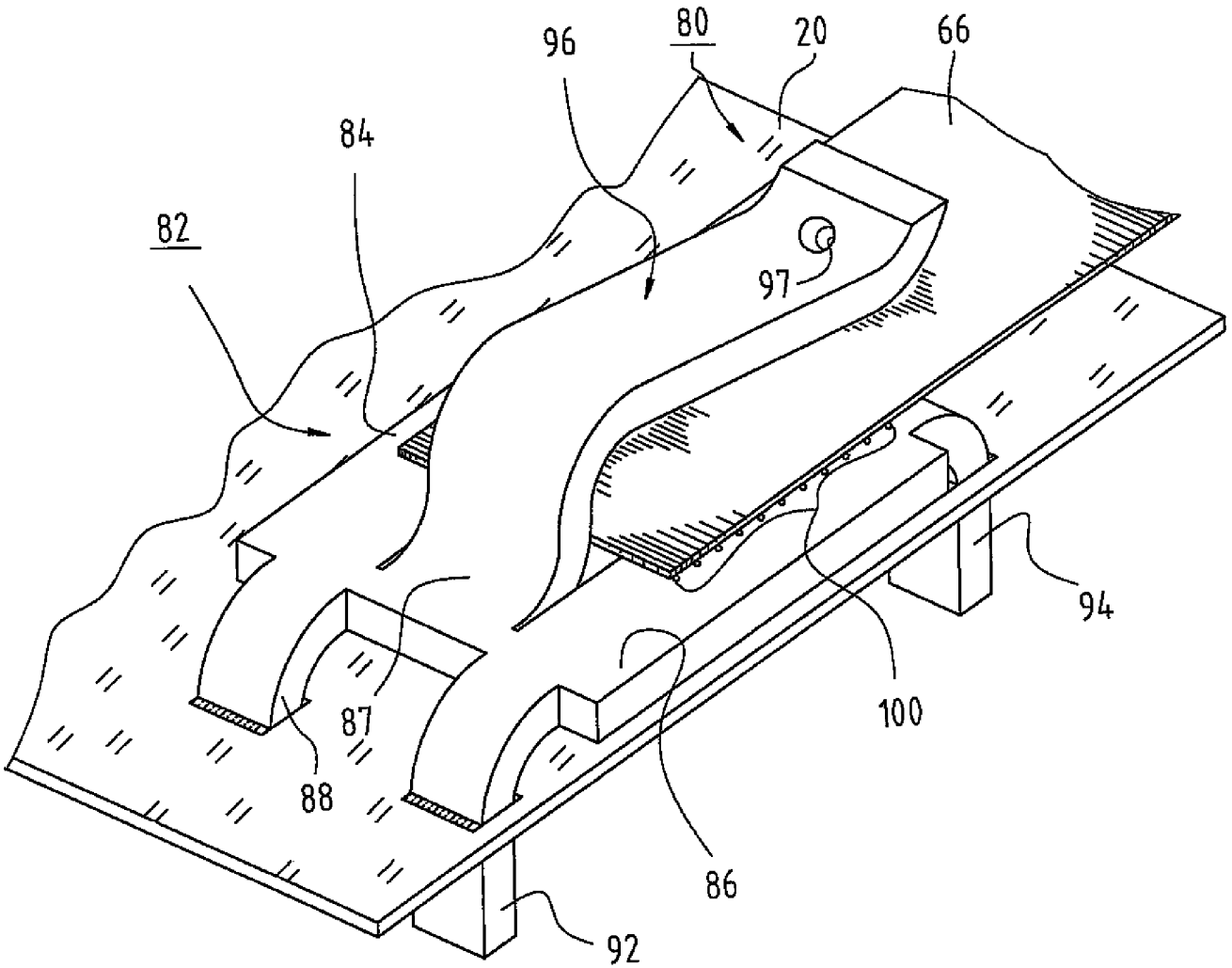
FIG. 7 depicts a circuit board having the contact element of FIG. 6.

FIG. 7 shows the mounting of a sheet-metal strip 66, serving as an external electrical conductor, on contact element 80. The latter is mounted on a circuit board 20 in the manner previously described, conductor path 22 (cf. FIG. 1) not being depicted here for simplicity's sake.

As is evident, contact element 80 is soldered in place, with its four feet 88, 90, 92, 94, in corresponding orifices of the circuit board. Sheet-metal part 66 is inserted between base part 82 and the resilient tongue 96. The latter has, on its side facing toward sheet-metal part 66, a lug 97 whose hollow upper side is visible in FIG. 7. Sheet-metal part 66 has a corresponding recess (not depicted), and when it is correctly introduced, lug 97 latches into that recess and thereby retains sheet-metal part 66 in lossproof fashion.

Sheet-metal part 66 is then welded, in its region labeled 100 in FIG. 7, to base part 82 by laser spot welding. The same preferably also occurs on the opposite side (not visible in FIG. 7). An extremely reliable electrical and mechanical connection, which can be produced without difficulty in automated fashion, is thereby obtained.

Mounting onto a circuit board 20 is accomplished in the same fashion as has been described in FIGS. 1 to 5 for the first exemplifying embodiment, i.e. by means of a press fit into holes of the circuit board, as depicted in FIG. 7, and additionally by way of corresponding soldered connections. For this purpose, feet 88, 90, 92, 94 can have a somewhat reduced width at their free ends in order to simplify installation in the holes of the circuit board.

The connection of a conductor path of the circuit board to an external electrical conductor has two components:

a) The connection from the conductor path to the contact element.

b) The connection from the contact element to the external conductor.

Connection component a) derives its secure nature from the combination of a pressing-in operation, which effects chiefly a mechanical but also an electrical connection, with a soldering operation in which the low-resistance electrical connection predominates but a mechanical connection is also produced.

Connection component b) derives its secure nature from the welding of the flat conductor to the contact element; the latching of the conductor, and the spring force at the contact tongue, effect an additional redundancy and facilitate assembly.

What is obtained by means of the invention is an electrical connection that is very secure, and that enables the conductor path of a circuit board to be connected securely and reliably to an external component in which large currents flow, e.g. to an electric motor. This secure and reliable connection is made possible by a press-in connection between circuit board and contact element and by a soldered connection to conductor path 22, and by weld connections 76, 78 produced in non-contact fashion and described in the context of FIG. 2. Assembly is extremely simple and can be automated without difficulty, this also being simplified by the latching between sheet-metal part 66 and spring tongue 54.

Many variants and modifications are of course possible in the context of the present invention.

The invention claimed is:

1. An electrical interconnection arrangement comprising a circuit board (20), a generally three-dimensional contact element (44; 80) having a base part (46; 82) facing said circuit board, said base part comprising flat portions (84, 86) extending parallel to said circuit board (20) and having a predetermined footprint;

an electrical conductor path (22) applied to the surface of said circuit board facing said contact element, and adapted to the shape of said footprint;

a solder connection (74) extending between said conductor path (22) and said flat portions extending parallel to the circuit board;

passthrough openings (24, 26, 28, 30, 32) located within a perimeter defined by edges of said conductor path (22);

metallized portions provided at at least one end of said passthrough openings (24, 26, 28, 30, 32);

feet (34, 36, 38, 40, 42; 88, 90, 92, 94) provided on said contact element (44; 80), said feet being redirected by bending to match associated passthrough openings, and pressed into these associated passthrough openings;

solder connections between said pressed-in feet and said associated metallized portions;

a contact tongue (54; 96) resiliently articulated on said base part (46; 82) and forming an insertion opening (64) between said contact tongue (54; 96) and said base part (46; 82) for insertion of an electrical conductor (66) into said insertion opening (64) and for connecting it to said contact element (44; 80).

2. The arrangement according to claim 1, wherein at least one lateral guidance member (70, 72) is provided on the contact element (44).

3. The arrangement according to claim 2, wherein the lateral guidance member (70, 72) is implemented integrally with the base part (46).

4. The arrangement according to claim 1, wherein said feet each have an attachment end adjacent said contact element, and a free end remote from said contact element, and at least some of the feet (34 to 42) have a reduced width (39) adjacent the free end (38) thereof.

5. The arrangement according to claim 1, further comprising an electrical conductor (66) engaged between the contact tongue (54) and the base part (46) and connected, by a welded connection (76, 78), to at least one element of a set defined by the base part (46) and the contact tongue (54).

6. The arrangement according to claim 5, wherein the welded connection (76, 78) is produced by laser welding.

7. The arrangement according to claim 5, wherein the electrical conductor (66) is a flat conductor.

8. The arrangement according to claim 5, wherein the electrical conductor (66) is configured for mechanical latching with the contact tongue (54; 96).

9. The arrangement according to claim 8, wherein the contact tongue (54; 96) comprises a projection (97), and the electrical conductor (66) is equipped with a recess for engagement of that projection.

10. The arrangement according to claim 1, wherein the contact element (44; 80) is equipped with at least one orifice (49) that defines a reservoir adapted to receive solder paste.

11. The arrangement according to claim 10, wherein the at least one orifice (49) is located in a region of the contact element (44; 80) adapted to be connected, by planar solder joining, to said conductor path (22) on said board.

12. The arrangement according to claim 1, wherein at least one portion of said contact element (44) is configured to rest snugly against said circuit board (20) while at least one of said feet (34', 40') has a major axis at an angle to said circuit board (20), thereby creating a bending radius at a connection between said foot and said contact element portion, and wherein a bowed segment (59) is provided at said connection, thereby defining a clearance between said segment and said board.

13. The arrangement according to claim 12, wherein said bowed segment (59), between said contact element portion and said at least one foot, is sufficiently bowed to completely reverse direction.

14. The arrangement according to claim 1, wherein said contact tongue (54) is mechanically biased to clamp said electrical conductor (66) between said base part (46) and said tongue (54).

* * * * *